US005220992A

United States Patent [19]

Milins

[11] Patent Number: 5,220,992

[45] Date of Patent: * Jun. 22, 1993

[54] APPARATUS FOR CONVEYING RODS OF THE CIGARETTE INDUSTRY

[75] Inventor: Desmond W. Milins, London, England

[73] Assignee: Molins Limited, London, England

[ * ] Notice: The portion of the term of this patent subsequent to Mar. 22, 2003 has been disclaimed.

[21] Appl. No.: 281,331

[22] Filed: Jul. 8, 1981

Related U.S. Application Data

[62] Division of Ser. No. 786,502, Apr. 11, 1977.

[30] Foreign Application Priority Data

Apr. 13, 1976 [GB] United Kingdom ..... 14940
Dec. 22, 1976 [GB] United Kingdom ..... 53685

[51] Int. Cl.[5] ..... B65G 47/26

[52] U.S. Cl. ..... 198/418; 198/444; 198/445; 131/282

[58] Field of Search ..... 198/418, 443, 444, 445, 198/447, 480, 481, 689, 347, 572, 573; 131/282, 283

[56] References Cited

U.S. PATENT DOCUMENTS

| | | | |
|---|---|---|---|
| 2,376,651 | 5/1945 | Bardet | 198/418 |
| 3,104,752 | 9/1963 | Rudszinat et al. | 198/481 |
| 3,355,004 | 11/1967 | Rupert | 198/572 |
| 3,503,488 | 3/1970 | Stone | 198/481 |
| 3,535,069 | 10/1970 | Molins et al. | 198/347 |
| 4,225,032 | 9/1980 | Gherardi | 198/481 |

FOREIGN PATENT DOCUMENTS 518471 1/1931 Fed. Rep. of Germany .

*Primary Examiner*—Joseph E. Valenza
*Attorney, Agent, or Firm*—Antonelli, Terry & Wands

[57] ABSTRACT

Apparatus for conveying rods of the cigarette industry, comprising a fluted drum for carrying rods in the flutes thereof, and means for feeding rods into the flutes of the drum, comprising movable conveyor means disposed in proximity to said drum for conveying a stack-like stream of the rods directly onto the drum whereby motion of the conveyor means towards the drum urges the stream of rods towards the drum and into contact therewith, thus ensuring that the flutes of the drum are filled with rods after passing the stack-like stream. Control means are preferably included for controlling movement of the conveyor means towards the drum whereby the said motion is sufficient to convey said stream of rods towards the drum at a rate just sufficient to fill the flutes of the drum.

9 Claims, 6 Drawing Sheets

APPARATUS FOR CONVEYING RODS OF THE CIGARETTE INDUSTRY

This application is a division of application Ser. No. 786,502, filed Apr. 11, 1977.

Filter-tipped cigarettes are commonly made by a filter attachment machine which joins pairs of cigarettes to opposite ends of double-length filter portions to form double filter-tipped cigarettes assemblies. These double assemblies are then cut through the middle to form two rows of individual filter-tipped cigarettes, the cigarettes of the two rows having their filters facing one another. The filter attachment machine furthermore includes a tip-turner device which reverses the orientation of the cigarettes in one of the rows and places those cigarettes between the cigarettes of the other row to form one row of cigarettes all having their filters facing in the same direction.

The cigarettes may then be tested pneumatically for leaks in their wrappers, and are sometimes also tested as regards the firmness of the tobacco ends, i.e. to ensure that the tobacco ends are adequately filled with tobacco. Subsequently the cigarettes are conveyed either in trays or as a continuous stream towards one or more packing machines.

One common problem in the cigarette industry is the loss of tobacco "shorts" (i.e. small particles of tobacco) from the cigarettes during their conveyance to the cigarette packing machine. The loss of shorts is not only wasteful but creates problems in that shorts tend to dirty the various equipments handling the cigarettes and, owing to their abrasiveness, they give rise to relatively rapid wear of moving parts and can also cause machine failure on account of accumulation of shorts in critical areas.

In this context it should be understood that the term "filter" is intended to cover any mouthpiece that may be required to be attached to cigarettes. For example a tubular mouthpiece may be used and may include inwardly projecting parts designed substantially to prevent the tobacco from entering the tube; such a mouthpiece may also include a filter.

According to the present invention, filter-tipped cigarettes are made by joining individual filters to opposite ends of double-length cigarette portions to form double assemblies, and these double assemblies are conveyed to at least one cigarette packing machine and are cut through the middle to form individual filter-tipped cigarettes at, in or near the packing machine.

After the cutting operation, the two rows of individual filter-tipped cigarettes may be formed into stack-like streams which may, for example, be fed downwards through two twisted chutes twisted in opposite directions so that the cigarettes of the two streams become similarly orientated. The two streams may then be combined into a single stream or may be fed separately directly into the hopper of a cigarette packing machine; another possibility is that the two streams of cigarettes may be fed to separate oppositely-oriented packing machines.

One advantage of the present invention is that the loss of shorts from the cigarettes is greatly reduced. Another advantage is that the cut-off device of the cigarette making machine (which cuts the continuous cigarette rod at regular intervals) can be simpler than the types of cut-off device normally required; the reason is that the quality of the cut (i.e. in regard to squareness and the avoidance of tearing) is less critical since the cut ends are enclosed in whatever form of encircling material is used to join filters to both ends of the double cigarette portions. The final cut by which the double assemblies are separated into individual filter-tipped cigarettes occurs while the assemblies are moving sideways and does not give rise to such problems at high speed; indeed it may be possible to cut the cigarettes, while they are moving in a stack-like stream, by means of a non-mechanical cut-off device, such as a laser, or by means of a vibrating linear knife or an endless band knife.

Another advantage of systems according to this invention, when compared with conventional systems, is that the avoidance of a tip-turner at the filter attachment machine represents a considerable cost saving. It would be possible, if desired, to use a similar tip-turner at the packing machine, but that is not necessary since the alternatives described above can instead be used (e.g. two twisted chutes).

The filters are preferably joined to the double-length cigarette portions by uniting bands which encircle the adjacent end parts of the filter and cigarette portions. For example, the two bands may be cut from webs formed by splitting a double-width web down the middle, basically as described in British patent specification No. 1,019,092.

Examples of the systems and apparatus according to this invention are shown in the accompanying drawings. In these drawings.

Figure 1:
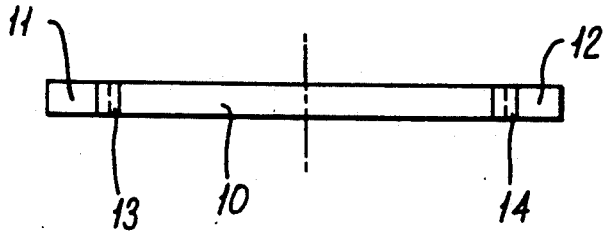
FIG. 1 shows an example of a double cigarette assembly such as may be used in systems according to this invention.

The systems shown in the drawings each include at least one filter attachment machine which forms double cigarette assemblies as shown in FIG. 1. Each assembly includes a double cigarette portion 10 which has individual filters 11 and 12 joined to opposite ends of it by uniting bands 13 and 14 which surround only the end portions of the filters, i.e. the end portions adjacent to the cigarette portion.

Figure 2:
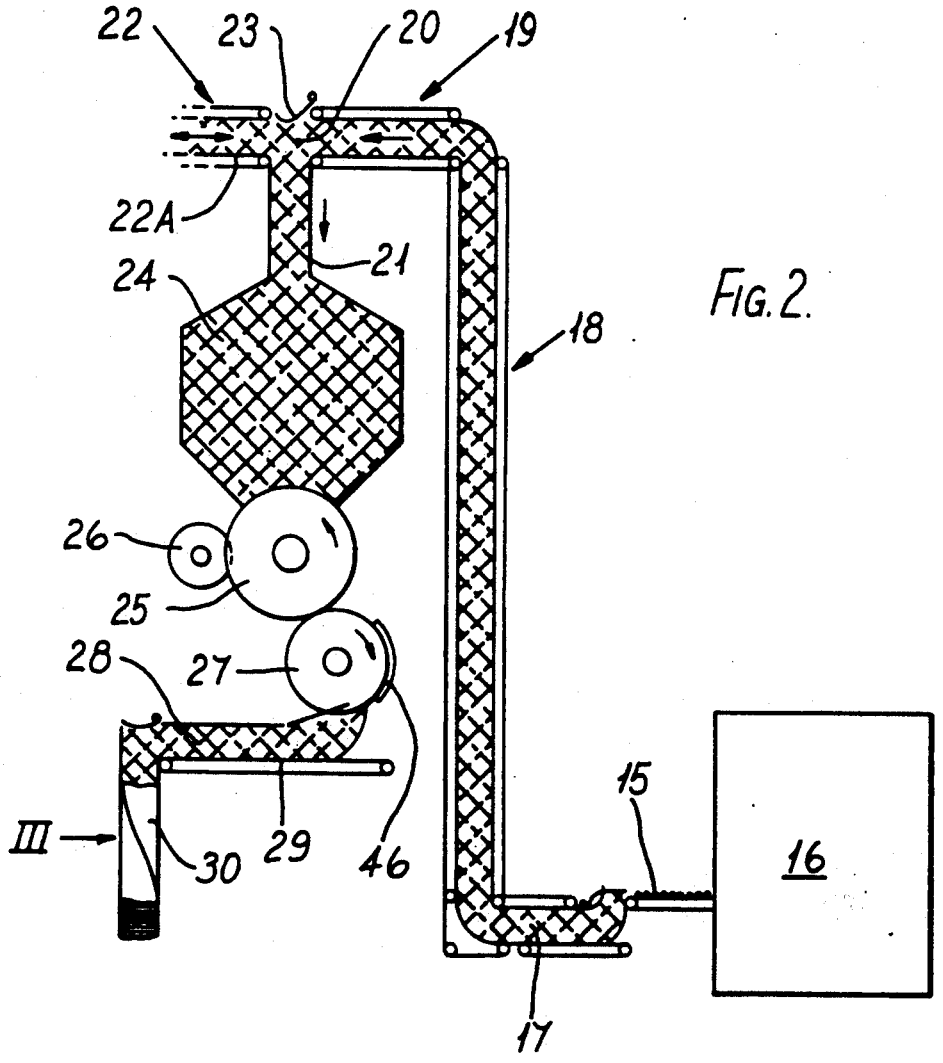
FIG. 2 is a diagrammatic view of one system.

FIG. 2 shows such double assemblies 15 being delivered as a single sideways-moving row by a filter attachment machine 16. These assemblies are then formed into a stack-like stream 17 which is conveyed upwards by an elevator 18 to an overhead conveyor 19. This last conveyor carries the stack-like stream to a junction 20 from which the assemblies can either pass downwards through a chute 21 or into a reservoir 22 comprising a reversible conveyor 22A. The reservoir absorbs assemblies or delivers assemblies into the junction, as necessary, in response to a sensor device 23 above the junction.

At the lower end of the chute 21 there is a container 24 which serves as an intermediate hopper, i.e. additional to the usual hopper of the cigarette packing machine (not shown). The container 24 is maintained full of assemblies. Assemblies are fed from the container in the flutes of a fluted drum 25. A rotary disc knife 26 cuts the assemblies through the middle to form two rows of individual filter-tipped cigarettes. These two rows are received by a further fluted drum 27; while being conveyed by the drum 27, the two rows are progressively pushed apart by a plough device 46. Each row is then formed into a continuous stack-like stream 28 which is carried by a conveyor 29 towards the upper end of a twisted chute 30 or 31, as shown in FIG. 2; one stream passes into the chute 30 and the other into the chute 31.

Figure 3:
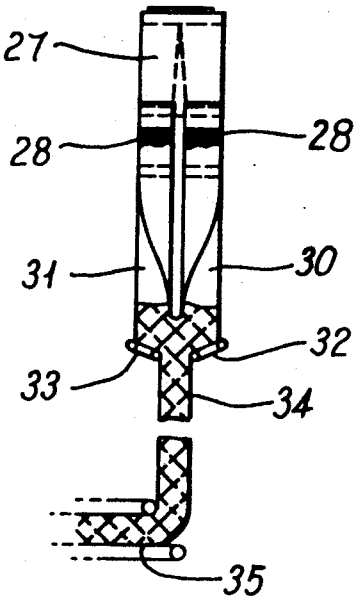
FIG. 3 is a view of part of the system shown in FIG. 2, taken in the direction of the arrow III in FIG. 2.

As shown in FIG. 3, the two chutes 30 and 31 are twisted through 90° in opposite directions so that the streams of cigarettes in the two chutes become similarly orientated, i.e. with their filters facing in the same direction. At the lower end of the chutes, bands 32 and 33 help to move the cigarettes towards a chute 34 which receives the combined stream of cigarettes.

The chute 34 is shown delivering the combined stream of cigarettes on to a conveyor 35 which carries the cigarettes (possibly via another elevator, if necessary) to the inlet of the hopper of a cigarette packing machine. Alternatively the chutes 30 and 31 may be arranged to deliver the cigarettes directly into the main hopper of a packing machine; as a modification of such an arrangement, if the entry point to the packing machine hopper is at a level above the lower ends of the chutes 30 and 31, the two stacks 28 may be fed to similar twisted chutes above the hopper via two side-by-side elevators.

The chute 34 may be twisted through 90° if the cigarettes are required to be returned to their original orientation.

The stream-combining arrangement shown in FIG. 2 may be replaced by the arrangement shown in FIG. 1 of our British patent applications Nos. 42872/74 and 346/75 (and corresponding German OLS 2,544.093).

Instead of only one filter attachment machine being used to deliver assemblies to the overhead conveyor 19, two or more filter attachment machines may be used and their outputs may be conveyed via a common overhead conveyor, for example as described with reference to FIG. 8 of our British patent specification No. 1,299,174.

Figure 4:
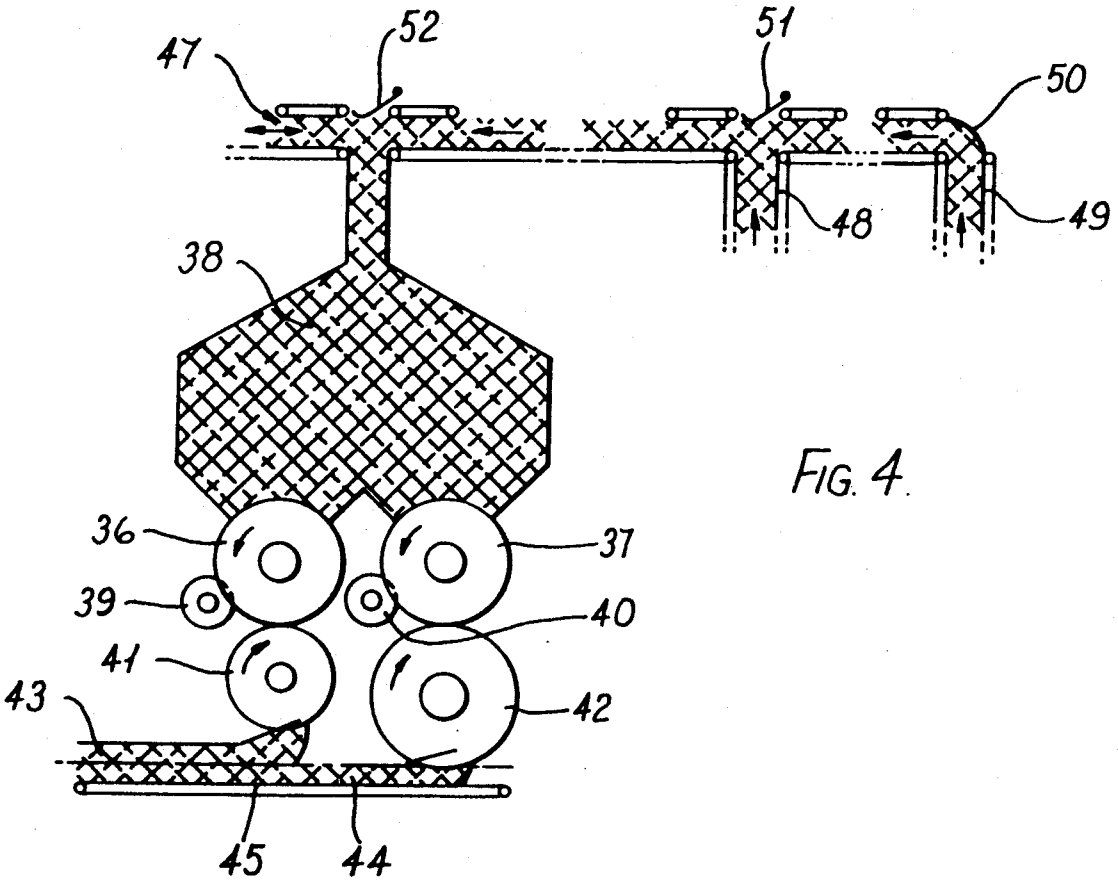
FIG. 4 is a diagrammatic view of another system.

Instead of all the assemblies being fed from the container 24 by a single fluted drum, two or more drums may be provided. FIG. 4 shows, by way of example, two fluted drums 36 and 37 being used to feed assemblies from a container 38. Each drum has a cooperating final-cut knife 39, 40 and delivers two rows of individual cigarettes to a drum 41, 42. The aligned rows on the two drums are then formed into two stack-like streams 43 and 44 which are deposited on a conveyor 45. It should be understood that FIG. 4 shows only one combined stack-like stream and that there is another similar stream alongside it. The two streams may be fed to two separate packing machines, which may be oppositely-orientated to take account of the opposite orientation of the cigarettes in the two streams; for example the conveyor 45 may comprise two side-by-side conveyors of which one extends, beyond the end of the other, to a packing machine which is located further from the container 38 than is the other packing machine.

The system shown in Fig. 4 also includes a reversible reservoir 47. In this example there are two elevators 48 and 49 which feed stack-like streams of assemblies from two filter attachment machines (not shown) to an overhead conveyor which includes speed-controlling sensors 50, 51 and 52.

The drums 41 and 42 may have plough devices, like the device 46 shown in FIG. 2, to move the two rows of cigarettes slightly away from one another.

Instead of the two stacks 28 in FIG. 2 (or the two double-layer stacks in FIG. 4) being fed side-by-side, they could be fed in opposite directions to two separate packing machines.

The double cigarette portions may be cut from a continuous rod in the cigarette making machine (not shown) by, for example, a cutting device of the general type described in British patent specification No. 1,413,188; that is to say a device consisting of two rotary members each carrying one or more blades, the blades of the two rotary members cooperating to shear the rod at regular intervals. Alternatively other simple and quiet-running cutting devices may be used since, as already explained, the quality of the cut is not critical.

The integrity of the cigarette wrappers may be tested at the filter attachment machine. Since the ends of the cigarette assemblies at the filter attachment machine are formed by filters, which are less prone to damage than tobacco ends, the formation of air-tight seals at the ends of the assemblies can be achieved quite simply by pressing sealing members against the opposite ends of the assemblies, for example as described in British patent specification No. 1,083,111.

The fluted drums which deliver the double assemblies from the containers may support the assemblies only at their ends, i.e. at the filter portions, to minimize damage. Similarly, as far as possible, the other conveying devices may be arranged to support the double assemblies at their ends.

The reservoir in each system may be basically as described in our British patent applications Nos. 45316/74 and 17162/75 (or corresponding German OLS 2,546,599) or as described in British patent specification No. 1,299,174.

FIGS 2 to 4 show systems in which the conveyor apparatus for conveying the double assemblies is arranged to convey the assemblies as a continuous stream. As an alternative, the double assemblies may be conveyed in trays in a manner which is basically well known in connection with the conveyance of conventional cigarettes between making the conveyance of conventional cigarettes between making and packing machines. In the conveyance of double assemblies in accordance with this invention, it is possible for deeper trays to be used, thus accommodating a larger number of cigarettes in each tray; not only does each tray have a higher stack of cigarettes, but each tray in effect contains two stacks of individual cigarettes, so that the cigarette carrying capacity of each tray can be more than doubled in comparison with trays commonly used in the past.

In the systems shown in FIGS. 2 to 4, in place of the reversible reservoirs 22 and 47 it is possible to use a storage device such as one of those described in British patent specification No. 1,404,141.

In the conveyance of double assemblies according to this invention, the assemblies can be stacked to a significant height without material risk of damage since the tobacco is sealed in by the end filters and since the pressure of the cigarette stack on the bottom few cigarettes can be borne effectively and symmetrically by the filters; for this latter purpose it will be understood that the cigarettes, especially when stacked to a significant height, should be carried by a conveyor wide enough to support both end filters of the cigarettes, or possibly by two parallel conveyors lying respectively below the two end filters.

Figure 5:
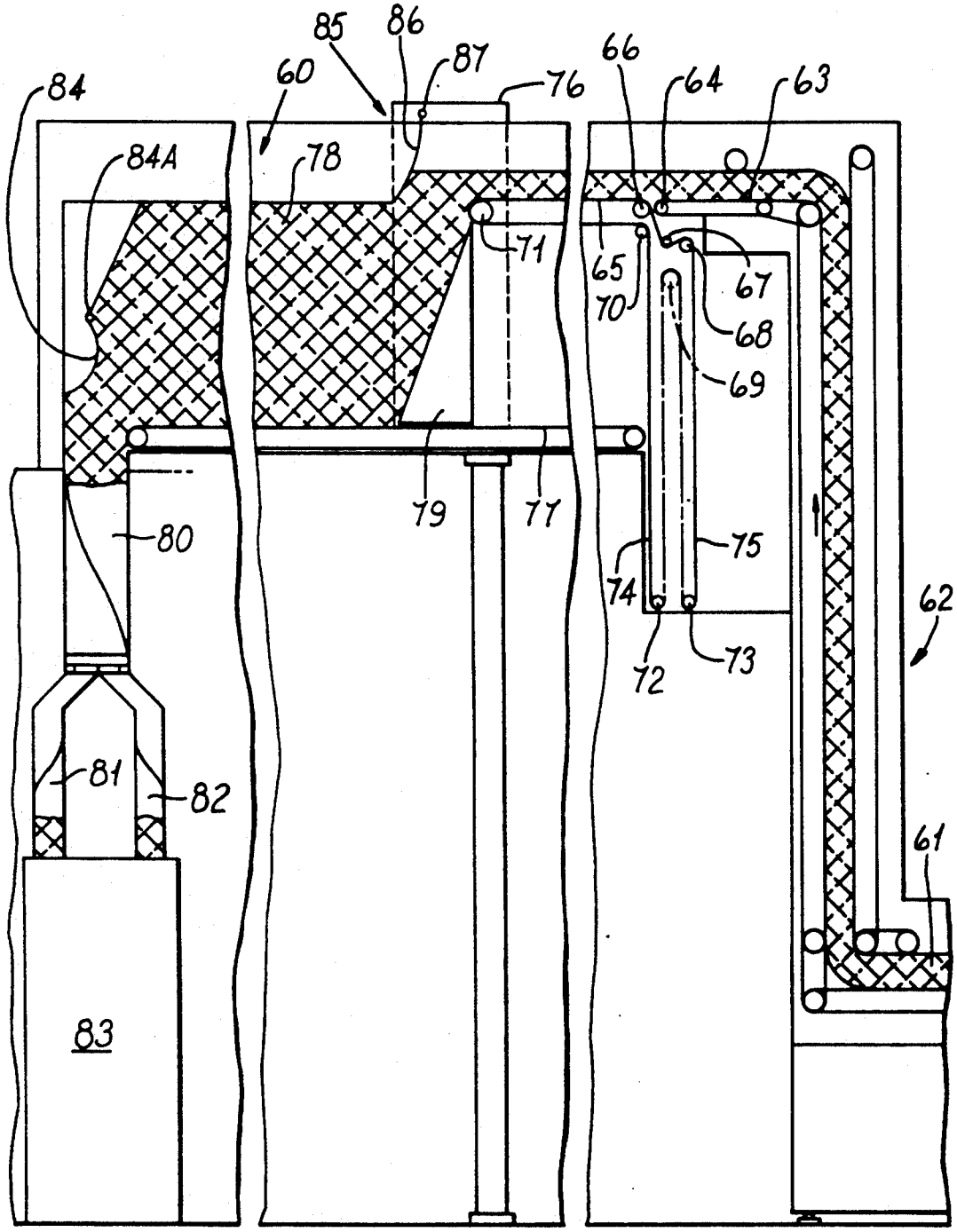
FIG. 5 shows a cigarette conveying system according to this invention including a first-in-first-out reservoir.

FIG. 5 shows a conveying system which takes advantage of the possibility of conveying the double assemblies as a deep stack. It includes a deep first-in-first-out reservoir 60. Double assemblies are delivered from a cigarette making machine (not shown) as a stack 61 which is conveyed upwards by an elevator 62 to a horizontal overhead conveyor 63. At its downstream end the conveyor 63 returns around a pulley 64, and the reservoir section begins immediately downstream of the pulley 64.

Figure 6:
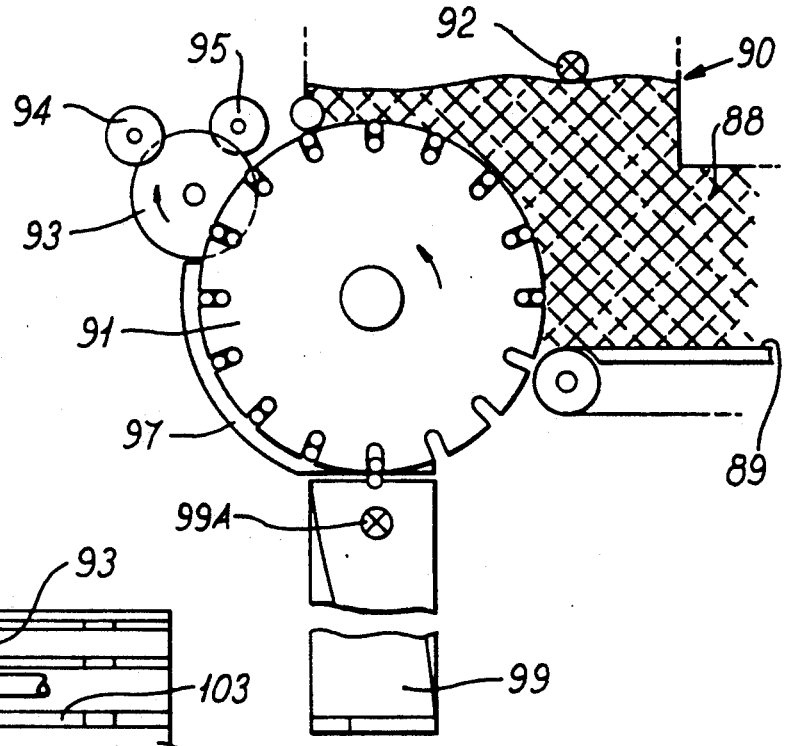
FIG. 6 is a diagrammatic front elevation of another arrangement for feeding the double assemblies from an intermediate hopper and for cutting the assemblies.
Figure 7:
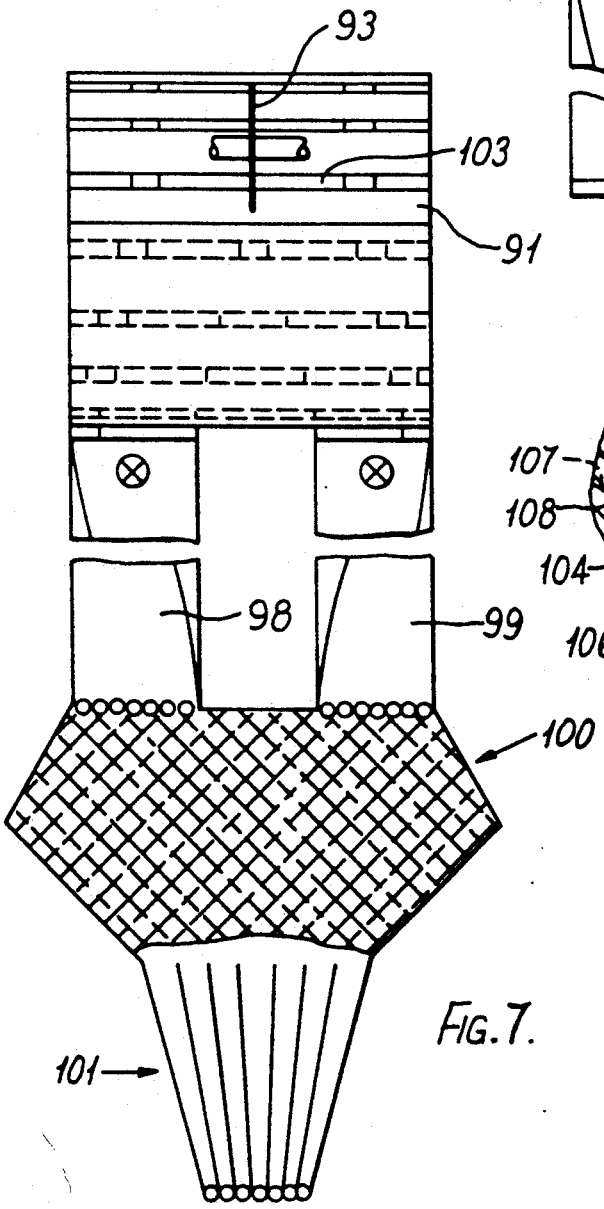
FIG. 7 is a view from the left of the arrangement shown in FIG. 6.

In the reservoir section the stack 61 is conveyed initially by a conveyor band 65 which passes around fixed pulleys 66 to 70, around a horizontally movable pulley 71 and around two weighted pulleys 72 and 73 lying in loops 74 and 75 formed by the band 65. The pulley 71 is mounted on a horizontally movable carriage 76. A deep stack of double assemblies 78 (e.g. about 24 inches deep) is formed on a conveyor 77 to the left of an end wall 79 carried by the carriage 76. At the downstream end of the conveyor 77 the cigarettes are delivered into a chute 80 which has a 90° twist so as to rotate the cigarettes through 90° as they passed down the chute. At the lower end of the chute, the cigarettes are cut through the middle (e.g. by a laser or endless band knife or while being conveyed in a fluted drum as shown in FIGS. 6 and 7) to produce two streams of individual filters-tipped cigarettes which then pass into oppositely twisted chutes 81 and 82 to bring all the cigarettes into the same orientation. From the chutes 81 and 82 the cigarettes may pass directly into the hopper of a cigarette packing machine 83.

Above the chute 80 there is a sensor which may comprise a plate 84 pivoted at 84A. This sensor controls the forward movement of the conveyor 77 so as to maintain the chute 80 always full of cigarettes. A sensor 85 (e.g. comprising a plate 86 pivoted at 87) is carried by the movable carriage 76 and controls movement of the carriage 76 and of the end wall 79 as follows: while cigarettes are being fed into the area beneath the sensor 85 by the conveyor 65 at a rate greater than that at which cigarettes pass down the chute 80, the cigarette excess is detected by the sensor 85 and this causes the carriage 76 and end wall 79 to be driven to the right to accumulate more cigarettes in the reservoir; on the other hand, when delivery of cigarettes through the chute 80 exceeds supply by the conveyor 65, the cigarette deficit beneath the sensor 85 causes the carriage 76 and end wall 79 to be driven to the left.

The fixed pulleys 68, 69 and 70 and the movable weighted pulleys 72 and 73 form a reservoir for the conveyor band 77 comprising the two loops 74 and 75. When the carriage 76 moves to the right, the length of the loops 74 and 75 increases, and vice versa. The movable pulleys 72 and 73 may be mounted on a vertically slidable carrier member so as to move upwards and downwards together. A downstream end section of the conveyor 77 may be formed by a separate conveyor band driven at a higher speed so as to loosen the stack of cigarettes before entry into the chute 80.

FIGS. 6 and 7 show one possible arrangement for cutting the double assemblies prior to entry into a packing machine. The double assemblies are fed as a continuous stack-like stream 88 by an overhead conveyor 89 to a small intermediate hopper 90. This hopper is partly defined by a fluted drum 91 which rotates in a counterclockwise direction and carries the double assemblies out of the hopper. Movement of the conveyor 89 may be controlled by a photo-electric device 92 to maintain cigarettes in the hooper approximately to the level of the device 92.

A disc knife 93 with associated sharpening wheels 94 and 95 cuts the double assemblies through the middle. The cigarettes are then drawn apart, for example by means of suction applied to both ends of the flutes in cooperation with a fixed cover plate 97. The two streams of oppositely-orientated cigarettes then arrive above two twisted chutes 98 and 99 shown particularly in FIG. 7. As the cigarettes pass down the chutes, they are rotated through 90° as that all the cigarettes arrive in a packing machine hopper 100 with the same orientation. The cigarettes then pass downwards through a set of vanes 101 from which batches of cigarettes are plunged out in the usual way.

Figure 8:
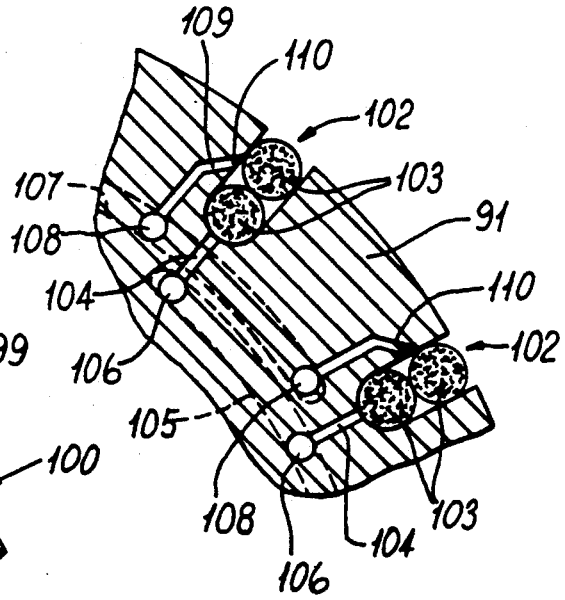
FIG. 8 is an enlarged view of part of the fluted drum shown in FIG. 6.

FIG. 8 is an enlarged view of part of the fluted drum 91 shown in FIGS. 6 and 7. As shown, the flutes 102 in the drum are deep enough to accommodate two double assemblies 103. During rotation of the drum, suction is applied initially through passages 104 leading to the bottoms of the flutes to ensure that the inner parts of the flutes are filled; this suction is transmitted from a suction manifold 105 via axial bores 106 with which a number of axially spaced passages 104 for each flute communicate. Subsequently, suction is transmitted from a suction manifold 107 via axial bores 108 and passages 109 to ports 110 lying outside the inner cigarettes to ensure that cigarettes are drawn into the outer parts of the flutes.

The fluted drum 91 is capable of delivering more cigarettes than are needed by the packing machine, and is arranged to be driven (e.g. via a disengageable electromagnetic clutch) only when a photo-electric device 99A indicates a space for more cigarettes in the upper end of the chute 99.

Figure 9:
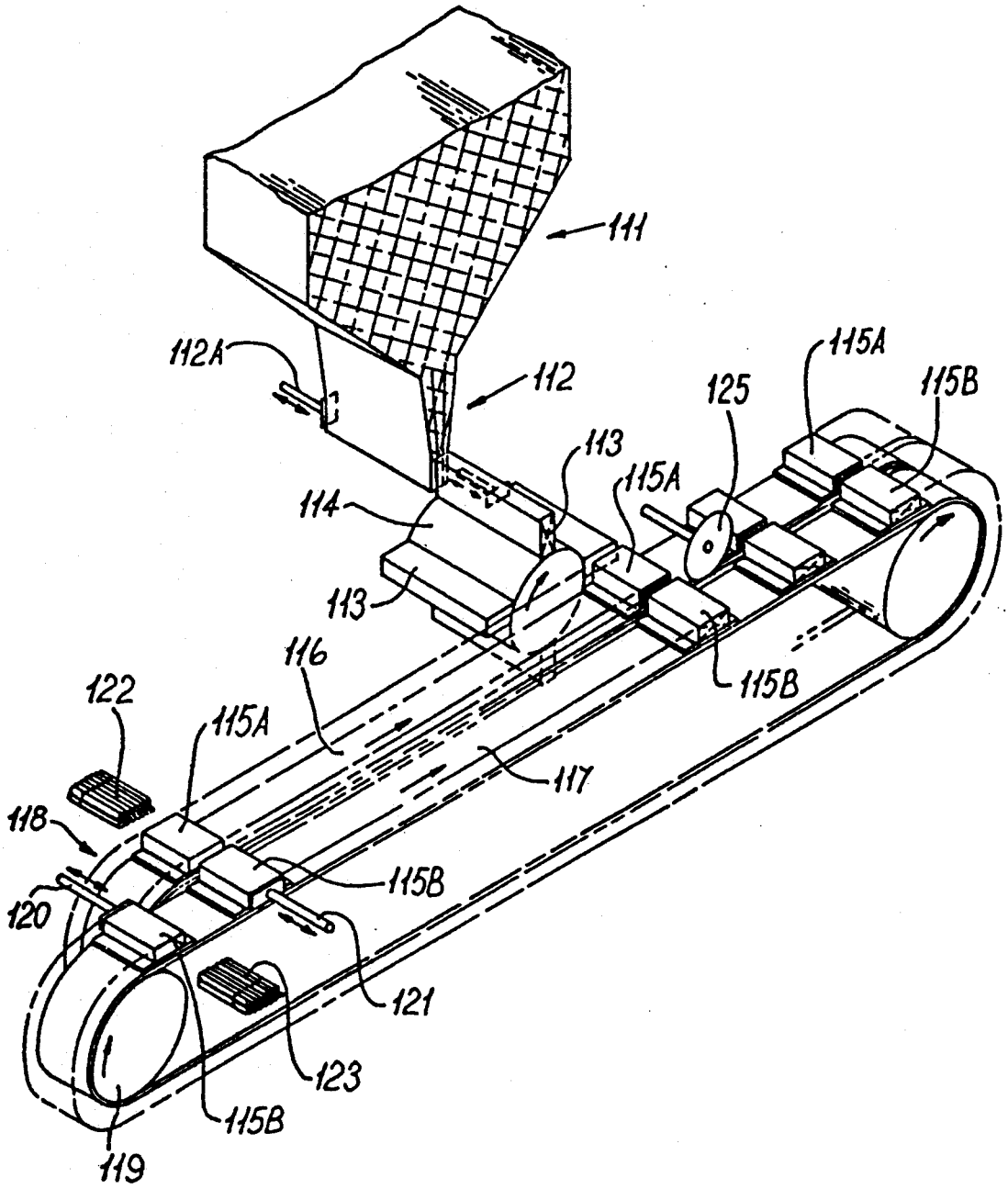
FIG. 9 is a diagrammatic perspective view of a different example in which the double assemblies are cut in a cigarette packing machine.

FIG. 9 shows a different arrangement in which the cutting of the double assemblies occurs in the packing machine itself. For this purpose the double assemblies are fed into a packing machine hopper 111 and then pass downwards as three streams through vanes 112. Batches of double assemblies (e.g. comprising three rows consisting of 7, 6 and 7 assemblies respectively) are plunged from the vanes 112 at regular intervals by a bifurcated plunger 112A and into successive pockets 113 of an intermittently rotating turret wheel 114 which has four pockets 113. While each batch is being plunged from the vanes 112, the preceding batch is plunged into a pocket comprising two parts 115A and 115B carried respectively by two conveyors 116 and 117 driven intermittently in time with the plunging operations. The parts 115A and 115B of the pockets are spaced apart to allow a disc knife 125 to cut each batch through the middle. The two batches of individual cigarettes thus formed are then carried separately by the two conveyors 116 and 117. The conveyor 116 returns around a pulley 118, while the conveyor 117 moves further to the left before returning around a pulley 119. In the region where the conveyor 117 is clear of the conveyor 116, a plunger 120 acts, while the conveyor is stationary, to plunge successive batches of individual cigarettes from the pocket halves 115B. The other batches of individual cigarettes are plunged from the pocket halves 115A by a plunger 121 which moves through the pocket halves 115B.

At this stage the two streams of cigarette batches 122 and 123 are oppositely orientated. The two streams may be conveyed into similar but oppositely orientated packing mechanisms. Alternatively, one of the streams may be reversed as to its orientation, after which the two streams may proceed separately or may be combined to form a single stream. Reversal of the orientation of one stream may, for example, be achieved by plunging the batches of one of the streams into a turret wheel rotating about a vertical axis, the batches being plunged from the turret wheel after 180° of rotation of the turret wheel.

As an alternative, instead of forming three channels, the vanes 112 may form seven channels, and the batches of assemblies (each consisting of three horizontal rows of say 7, 7 and 6 cigarettes respectively) may be plunged directly from the vanes into the pockets 115A, B.

Figure 10:
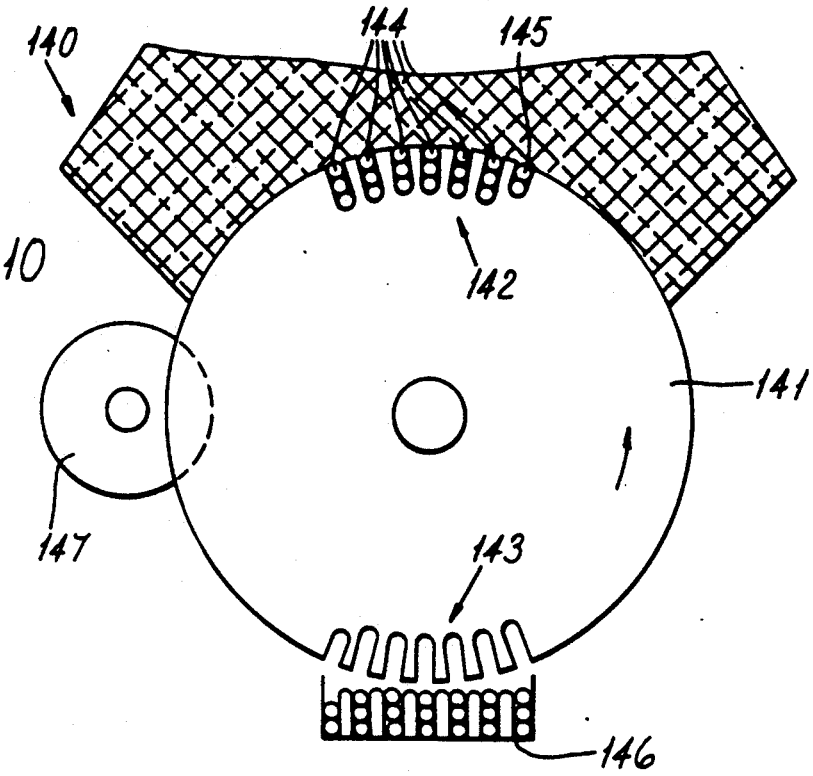
Figure 11:
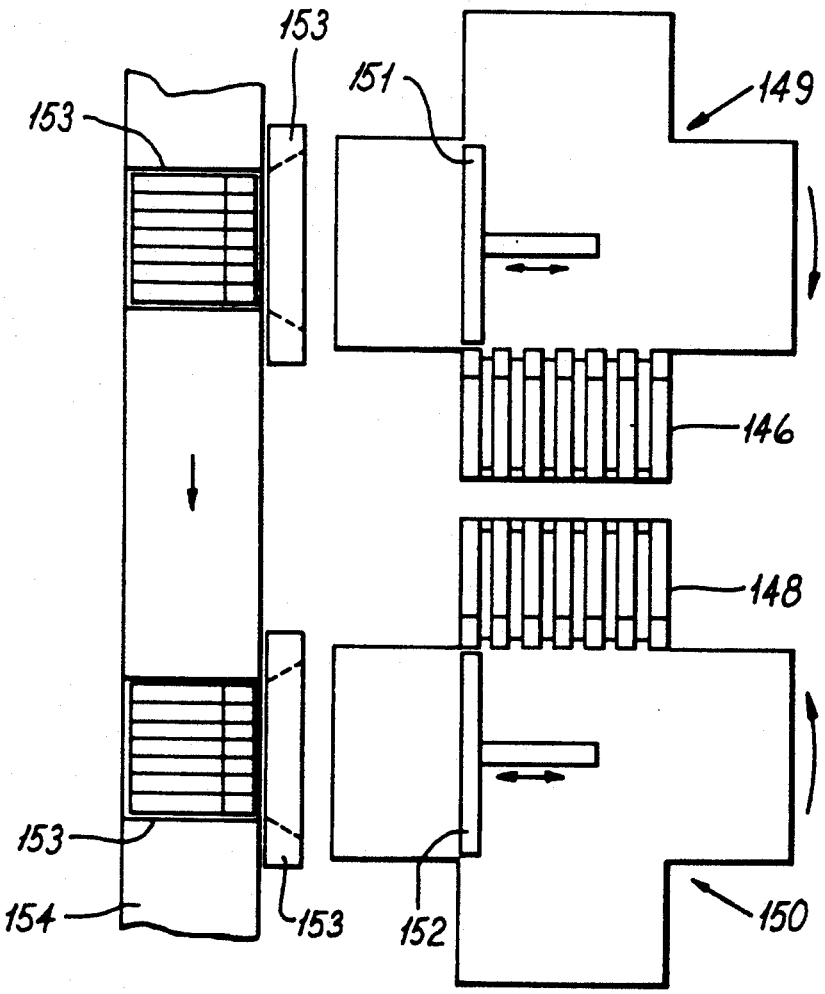

FIGS. 10 and 11 show a different form of apparatus which avoids the need for the packing machine to include vanes in forming batches of cigarettes to be packed. Double assemblies in this example are fed into a hopper 140 and are delivered from the hopper by an intermittently rotating fluted drum 141. The drum 141 has a number of circumferentially spaced groups of flutes of which two groups 142 and 143 are shown.

The arrangement shown is capable of forming groups of 20 double assemblies. For that purpose each group of flutes comprises six flutes 144 deep enough to receive three assemblies and one flute 145 deep enough to receive only 2 assemblies. The group 142 is shown full of assemblies, while the group 143 is shown after the assemblies which it has carried from the hopper 140 have been discharged, for example by means of compressed air blown into the bottom ends of the flutes.

A circular disc knife 147 cuts the double assemblies through the middle during rotation of the drum in a counter-clockwise direction to form batches of 20 individual cigarettes. These batches are then separated during further rotation of the drum 41 so that they can be delivered respectively into pockets 146 and 148 formed in two intermittently rotating turret wheels 149 and 150 shown in FIG. 11 (which is a plan view). The turret wheels 149 and 150 rotate intermittently in opposite directions through steps of 90°. After 90° of rotation, each batch of individual cigarettes is pushed out of the pocket 146, 148 by a plunger 151 or 152, via a guide 153 and into a pocket 153 carried by an intermittently movable conveyor 154; the guides 153 have passages which converge so as to compress the batches and may also guide the cigarettes within each batch into different relative positions. At this stage (i.e. on the conveyor 154) the cigarettes are all similarly orientated. It will be appreciated that the conveyor 154 must index forward, following each plunge operation, by a distance equal to twice that between successive pockets 153.

During manufacture of the double assemblies, the filters may be joined to the ends of the double-length cigarette portions by means of uniting bands formed by portions of pre-gummed, pre-printed paper. For example, the pre-gumming may comprise a hot-melt adhesive which is activated by heat before the uniting band is rolled around adjacent parts of the cigarette and filter portions. The printing borne by each uniting band may comprise any legend or insignia appropriate to the particular brand of cigarette.

In preparation for assembly of the filters to opposite ends of the cigarette portions, the filters may be fed axially into opposite ends of flutes in a drum carrying the double-length cigarette portions. For example, the filters may be fed pneumatically into the flutes in a manner basically as described in our British patent application 21365/75 (in particular FIGS. 6 and 7) or in our corresponding published German Patent Application P 26 22 449.7. Another possibility is that the filters may be conveyed axially in two streams towards opposite ends of the flutes containing the cigarette portions, and each filter may then be projected into the corresponding flute at a higher speed by means of an accelerator wheel which may be formed with one or more lobes to grip the filters and drive them forward into the flutes.

We claim:

1. Apparatus for conveying rods of the cigarette industry, comprising a fluted drum for carrying rods in the flutes thereof, means for rotating said drum at a predetermined speed, and means for feeding rods into the flutes of the drum comprising movable conveyor means disposed in proximity to a generally-upward moving portion of said drum for conveying a continuous multi-layer stack-like stream of the rods directly onto the drum in a direction transverse to the general direction of movement of the portion of the drum adjacent to the conveyor, whereby motion of the conveyor means towards the drum urges the stream of rods towards the drum and into contact therewith, thus ensuring that the flutes of the drum are filled with rods after passing the stack-like stream.

2. Apparatus according to claim 1 including control means for controlling movement of the conveyor means towards the drum whereby the said motion is sufficient to convey said stream of rods towards the drum at a rate just sufficient to fill the flutes of the drum.

3. Apparatus according to claim 2 in which the conveyor means includes means for permitting limited upward motion of the rods in an area adjacent to the drum, and in which the control means comprises sensor means responsive to said upward motion for controlling the motion of the conveyor means.

4. A device according to claim 1 in which the conveyor means extends substantially horizontally towards the drum.

5. A device according to claim 4 in which each of the flutes of the drum is deep enough to receive at least two rods.

6. A device according to claim 5 including a knife which is arranged to cut the rods while they are in the flutes of the drum.

7. A device according to claim 2 in which the control means for controlling movement of the conveyor means includes a photoelectric sensor device responsive to the height of the rods in the vicinity of the end of the conveyor adjacent to the drum.

8. Apparatus for conveying rods of the cigarette industry, comprising a fluted drum for carrying rods in the flutes thereof; drive means for rotating said drum at a predetermined speed; means for feeding rods into the flutes of said drum in a region where the flutes are moving in a generally-upward direction, said feeding means comprising movable conveyor means for conveying a continuous multi-layer stack-like stream of rods in a direction generally transverse to the direction of movement of the flutes of the drum in the said region so that the leading end of said stream bears against a portion of the surface of said fluted drum in the said region; and control means for effecting controlled movement of said conveyor means and said drum so that the quantity of rods supplied to said drum from said stream approximates the quantity of rods conveyed away from said stream in said flutes.

9. Apparatus according to claim 8 wherein said control means includes sensor means responsive to the height of said stream for controlling the speed of said conveyor means.

* * * * *